US005385238A

United States Patent [19]

Lancaster et al.

[11] Patent Number: 5,385,238

[45] Date of Patent: * Jan. 31, 1995

[54] CUSHION FOR USE IN A SHIPPING CONTAINER

[75] Inventors: Gary D. Lancaster, Lewisburg, Tenn.; Greg A. Hutcheson, Conyers, Ga.

[73] Assignee: The Mead Corporation, Dayton, Ohio

[ * ] Notice: The portion of the term of this patent subsequent to Mar. 30, 2010 has been disclaimed.

[21] Appl. No.: 38,361

[22] Filed: Mar. 29, 1993

Related U.S. Application Data

[63] Continuation-in-part of Ser. No. 907,073, Jul. 1, 1992, Pat. No. 5,197,606.

[51] Int. Cl.[6] ..... B65D 81/02

[52] U.S. Cl. ..... 206/594; 206/486; 206/588; 206/589; 206/591

[58] Field of Search ..... 206/320, 326, 477, 482, 206/483, 486, 487, 585, 586, 588, 589, 590, 591, 592, 594; 229/904, 161

[56] References Cited

U.S. PATENT DOCUMENTS

| | | | |
|---|---|---|---|
| 2,160,816 | 6/1939 | Barnes | 206/586 |
| 2,410,591 | 11/1946 | Turner | 206/591 |
| 2,620,062 | 12/1952 | Schuler | 206/320 |
| 2,894,672 | 7/1959 | Bamberg | 206/585 |
| 3,015,428 | 1/1962 | Magazzu | 296/592 |
| 3,123,274 | 3/1964 | Burke | 206/592 |
| 3,149,770 | 9/1964 | Spillson | 229/904 |
| 3,182,885 | 5/1965 | Maio | 206/592 |
| 3,497,057 | 2/1970 | Traner et al. | 206/585 |
| 3,499,595 | 3/1970 | Brooks | 229/904 |
| 3,532,263 | 10/1970 | Ross | 206/585 |
| 3,565,323 | 2/1971 | Katzenmeyer | 229/904 |
| 3,722,781 | 3/1973 | Page et al. | 229/904 |
| 3,921,890 | 11/1975 | Reihm | 206/592 |
| 3,971,472 | 7/1976 | Veenman | 206/590 |
| 4,008,804 | 2/1977 | Poggiali | 206/320 |
| 4,019,672 | 4/1977 | Giannini | 206/592 |
| 4,170,297 | 10/1979 | Johnson | 206/588 |
| 4,230,258 | 10/1980 | Lane | 206/590 |
| 4,294,358 | 10/1981 | Nauheimer et al. | 206/589 |
| 4,469,224 | 9/1984 | Ritter | 206/591 |
| 4,498,580 | 2/1985 | Getz et al. | 206/592 |
| 4,832,190 | 5/1989 | Favreau | 206/588 |
| 5,197,606 | 3/1993 | Lancaster | 206/594 |

FOREIGN PATENT DOCUMENTS

| | | | |
|---|---|---|---|
| 2415048 | 9/1979 | France | 206/591 |

*Primary Examiner*—David T. Fidei
*Attorney, Agent, or Firm*—Tsugihiko Suzuki

[57] ABSTRACT

A cushion for placement into a shipping container comprises a bottom panel, a side panel foldably joined to the side edge of the bottom panel, a top panel foldably joined to the upper end of the side panel and disposed in a spaced parallel relation to the bottom panel, a support panel foldably joined to the top panel, the support panel being disposed in a spaced parallel relation to the side panel, an anchor flap foldably joined to the lower end of the support panel and secured to the bottom panel in a flat face contacting relation, the anchor flap extending from the lower end of the support panel in a direction away from the side panel, and a retaining flap for holding the cushion in a set-up condition. The cushion may be collapsed such that the top panel, the support panel and the anchor flap are disposed in the same plane.

23 Claims, 10 Drawing Sheets

CUSHION FOR USE IN A SHIPPING CONTAINER

This application is a continuation in part of U.S. patent application Ser. No. 907,073, filed Jul. 1, 1992, now U.S. Pat. No. 5,197,606.

BACKGROUND OF THE INVENTION

The present invention relates to a cushion or pad for placement in a shipping container, and more particularly to a collapsible cushion formed preferably of corrugated board, which can be set up easily from a flat collapsed condition. The present invention also relates to a shipping container incorporating such a cushion.

One cushion known in the art is a skid type cushion designed to be laid underneath an article in a shipping container. This cushion comprises a bottom panel and two double walled tubular structures disposed side by side on the bottom panel. The tubular structures are locked in their positions on the bottom panel by lock tabs struck from the bottom panel. The tubular structures also are interconnected and reinforced by end flaps. This cushion is formed from a rectangular blank of corrugated board having its opposite end margins folded along parallel fold lines into the two tubular structures respectively.

The cushion mentioned above must be fully assembled directly from a blank before it is placed in a shipping container. This assembling process, the two tube-forming process in particular, is not only laborious and time consuming, but also physically stressful due to a great deal of wrist-twisting work required in the process. Furthermore, this cushion is extremely difficult to fold flat without full disassembly into a blank form. Apart from the above, a good deal of material is required to form the two tubular structures.

What is needed, therefore, is an improved collapsible cushion for use in a shipping container. Such a cushion should require less material and be easy to manipulate to set up and to fold flat.

SUMMARY OF THE INVENTION

The present invention provides a collapsible cushion that is easy to set up as well as to fold flat. Such a cushion comprises a bottom panel, a side panel, a top panel, a support panel, an anchor flap and retaining means. The side panel is foldably joined to the side edge of the bottom panel. The top panel is foldably joined to the upper end of the side panel and disposed in a spaced parallel relation to the bottom panel. The support panel is foldably joined to the top panel and extends to a lower end so that the support panel is disposed in a spaced parallel relation to the side panel. The anchor flap is foldably joined to the lower end of the support panel and extends in a direction away from the side panel. This anchor flap is secured to the bottom panel in a flat face contacting relation. The retaining means functions to hold the cushion in a set-up condition in which the side, top and support panels and at least a portion of the bottom panel in cooperation form a squared tubular structure.

This cushion may be supplied in a collapsed condition wherein the side, top, support and bottom panels form a flat collapsed tube, and may be set up from the collapsed condition at a place of packing, i.e., a place where the cushion is positioned into a shipping container. Setting up of this cushion can be achieved simply by erecting the side and support panels and by operating the retaining means.

This cushion has an advantage particularly in the collapsing process thereof because the cushion or the tubular structure can be collapsed such that the top panel, the support panel and the anchor flap are disposed in the same plane. In a different arrangement wherein the anchor flap extends toward the side panel, the support panel must be folded onto the anchor flap or the top panel must be folded onto the support panel and the anchor flap when the cushion is collapsed. Accordingly, minimum folding stress is induced in the cushion of the present invention when the cushion is collapsed.

Besides, this cushion eliminates the use of double walled tubular structures on a bottom panel and thus requires less material than those conventional cushions.

In one preferred embodiment, the cushion is provided also with a second side panel and a second top panel. The second side panel is foldably joined to a second side edge of the bottom panel which second side edge is disposed opposite the first side edge of the bottom panel. The second side panel is disposed in a spaced parallel relation to the first side panel. The second top panel is foldably joined to the upper end of the second side panel and extends toward the first side panel. The second top panel is disposed in a spaced parallel relation to the bottom panel and is secured to the first top panel in an overlapping relation.

In an alternative preferred embodiment, the cushion is provided with a second side panel, a second top panel, a second support panel and a second anchor flap. The second side panel and the second top flap are arranged in the same manner as they are in the foregoing preferred embodiment except that the second top panel is neither overlapped with nor secured to the first top panel. The second support panel is foldably joined to the second top panel and is disposed in a spaced parallel relation to the second side panel. The second anchor flap is foldably joined to the lower end of the second support panel and is secured to the bottom panel in a flat face contacting relation. The second anchor flap extends from the lower end of the second support panel toward the first side panel. According to this embodiment, the tubular structure is formed by the second side, second top and second support panels and a part of the bottom panel, which cushion may be collapsed such that the second top and second support panels and the second anchor flap are disposed in the same plane.

In a further alternative preferred embodiment, the cushion comprises a liner panel joined to the anchor panel. The liner panel extends from the anchor panel toward the side panel and is secured to the bottom panel in a flat face contacting relation so that the bottom panel is reinforced. Such a reinforcing liner panel is not formed by extra material but by material struck partially from the top panel and partially from the support panel. As a result, material requirement of the cushion is minimized.

Another aspect of the present invention is directed to a shipping container comprising a casing for receiving an article and a cushion of the forgoing aspect of the invention which cushion is received in the casing.

Accordingly, it is an object of the present invention to provide a collapsible cushion which is easy to fold flat as well as to set up from a flat collapsed condition.

Another object of the present invention is to provide a collapsible cushion in which minimum folding stress is induced when the cushion is collapsed.

A further object of the present invention is to provide a corrugated board cushion which minimizes corrugated board requirement.

Other objects and advantages of the present invention will be apparent from the following description, the accompanying drawings and the appended claims.

DETAILED DESCRIPTION OF THE PREFERRED EMBODIMENTS

Figure 1:
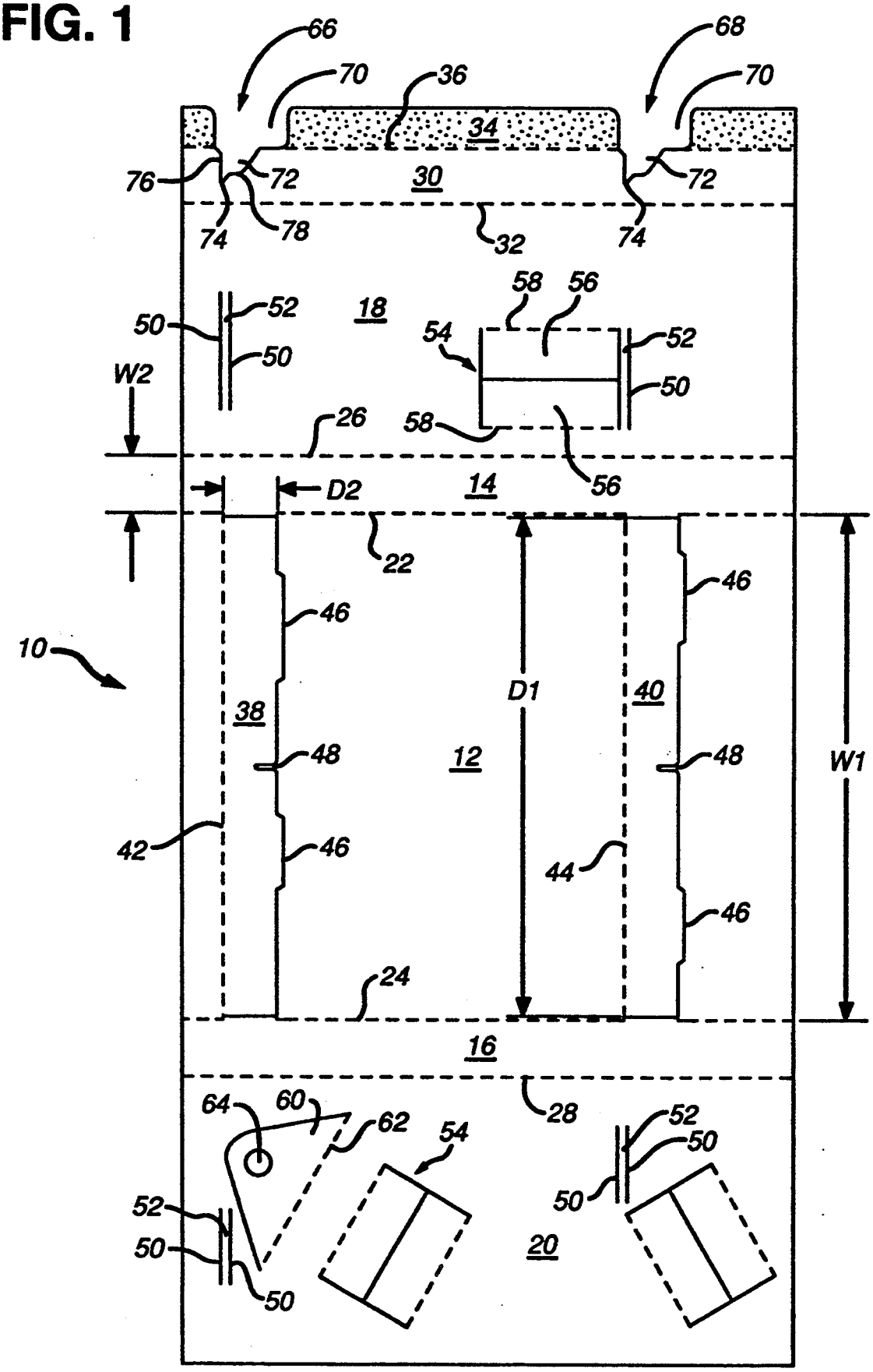
FIG. 1 is a plan view of a blank from which a cushion according to the present invention is formed.

A cushion according to the present invention is illustrated in blank form in FIG. 1 wherein reference numeral 10 designates a generally rectangular blank for forming a cushion/cushioning member to be laid underneath a water heater. The blank 10 is formed of corrugated board and includes five main panels joined in series in a row. More particularly, the blank 10 has a rectangular bottom panel 12, a pair of slat-like side panels 14 and 16 and a pair of rectangular top panels 18 and 20. The side panels 14 and 16 are foldably joined respectively to the opposite side edges of the bottom panel 12 along fold lines 22 and 24. The side panels extend away from the bottom panel 12 to outer edges 26 and 28, and the top panels 18 and 20 are foldably joined respectively to the outer edges of the side panels 14 and 16 along fold lines 26 and 28.

Beside the five main panels, a center support panel 30 is foldably joined to the free side edge of the top panel 18 along a fold line 32. A glue or anchor flap 34 is further foldably joined along a fold line 36 to the side edge of the center support panel 30 opposite the fold line 32.

The fold lines 22, 24, 26, 28, 32 and 36 are parallel to one another. The side panels 14 and 16 are of the same shape and size, whereas the center panel 30 is equal in length and width to the side panels 14 and 16.

The bottom panel 12 has two retaining flaps 38 and 40 struck respectively from the portions near the opposite end edges thereof. These retaining flaps 38 and 40 are foldably joined to the bottom panel 12 along crease lines 42 and 44 extending across the width (W1) of the bottom panel 12 between the fold lines 22 and 24. Stated differently, each retaining flap has a longitudinal dimension (D1) generally equal to the width (W1) of the bottom panel 12. The lateral dimension (D2) of each retaining flap is generally equal to the width (W2) of the side panels 14 and 16. Locking tabs 46 are provided at the free edge of each retaining flap whereas a notch 48 is formed in that portion of each retaining flap between the locking tabs 46.

Each of the top panels 18 and 20 has two pairs of parallel straight cut lines 50 extending along the width of the top panel. Each pair of the cut lines 50 define a strip 52 slightly displaceable in a direction perpendicular to the associated panel portion. When displaced, these strips 52 respectively define slots which cooperate with the locking tabs 46, which will be described later in more detail.

The top panel 18 has a H-shaped cut 54 whereas the top panel 20 has two H-shaped cuts 54. Each H-shaped cut 54 defines a pair of opposed bend flaps 56 which are foldable about fold lines 58. These bend flaps 56, when folded inwardly, define an opening. These openings are designed to receive the legs of a water heater. In the top panel 18, one of the parallel cut lines 50 serves at the same time as a part of the H-shaped cut 54. A substantially triangular tab 60 is struck from the panel portion 20. This tab 60 is foldably joined along a fold line 62 to the panel portion 20 and has an aperture 64 for receiving a pipe portion, such as a drain pipe and supply pipe, of the water heater.

The center support panel 30 and the glue flap 34 together as a single keel portion is provided with two cutouts 66 and 68. The cutout 66 is formed at a distance from the adjacent one of the opposite end edges of the keel portion. This distance is generally equal to the distance between the retaining flap 38 and the adjacent end edge of the bottom panel 12. Likewise, the distance between the cutout 68 and the adjacent end edge of the keel portion is generally equal to the distance between the retaining flap 40 and the adjacent end edge of the bottom panel 12. Each cutout consists of a larger portion 70 and smaller portion 72. The larger portion 70 opens to the free side edge of the glue flap 34 and extends all the way across the width of the glue flap 34. The smaller portion 72 extends into the center panel 30 and terminates at a tip end 74 from which a straight edge 76 and an arcuate edge 78 extend toward the larger portion 70 to define the smaller portion 72.

Figure 2:
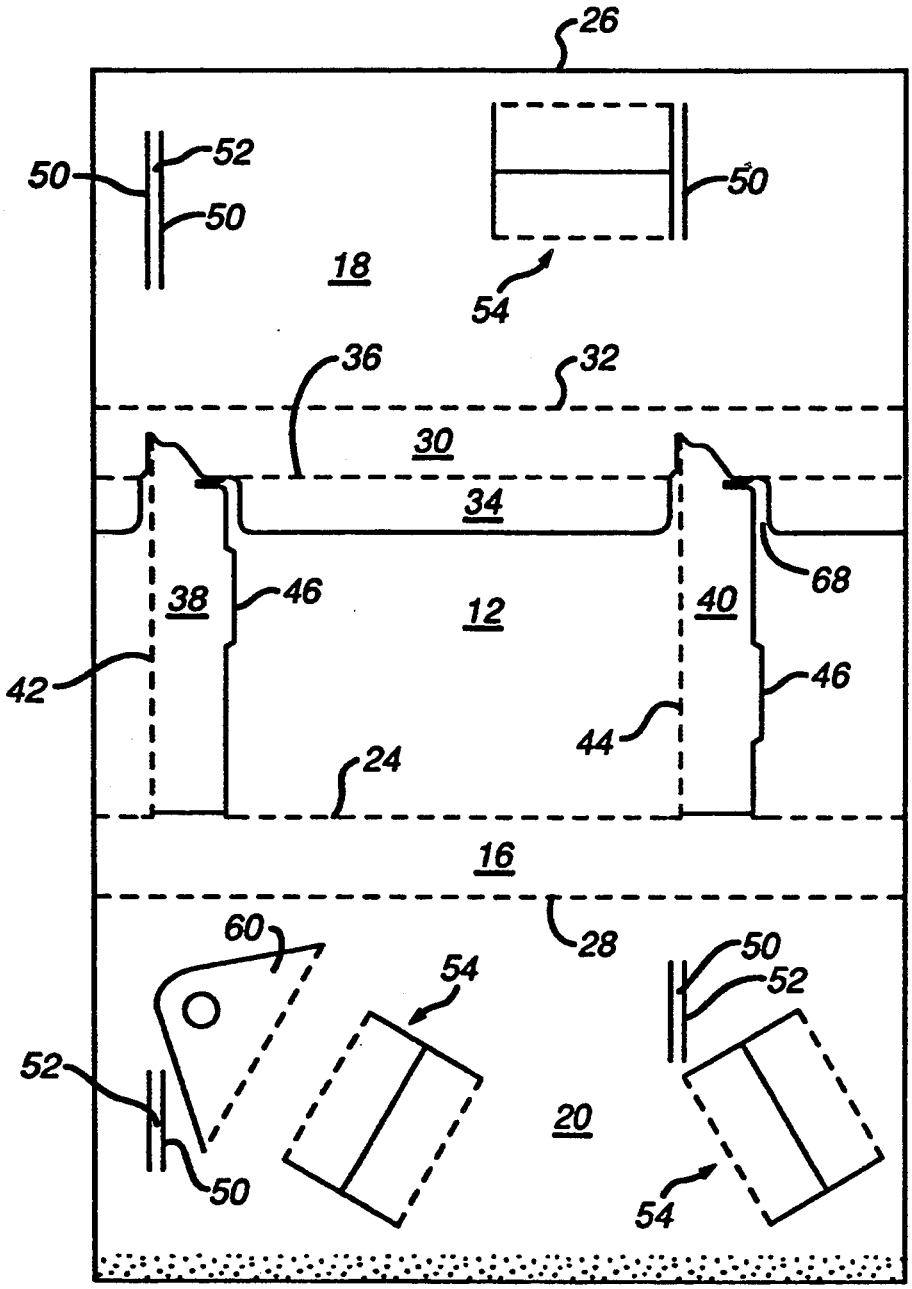
FIGS. 2 and 3 are plan views depicting intermediate stages through which the blank of FIG. 1 is manipulated and glued in order to form a completed cushion of the present invention.
Figure 3:
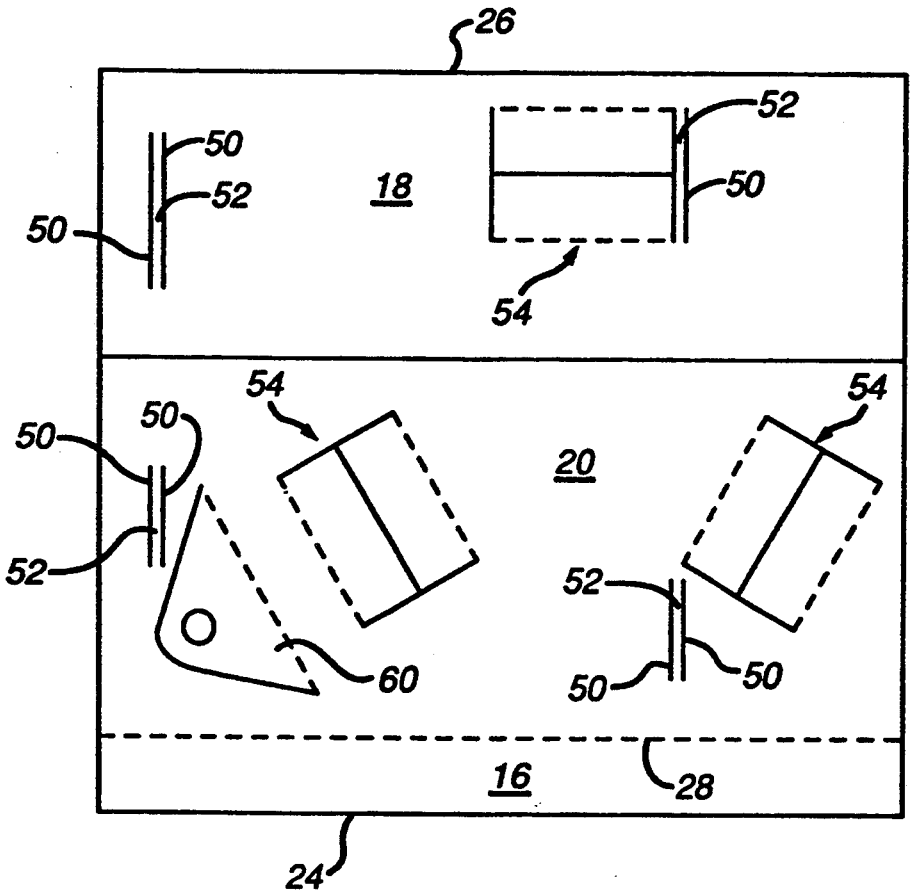

The blank 10 described above is preformed, preferably at the place where the blank is manufactured, into a flat collapsed tubular structure. To preform a flat structure from the blank 10, the following steps are taken. First, glue is applied to the glue flap 34 as shown by the stippling in FIG. 1. Then the top panel 18, the center support panel 30 and the glue flap 34 are folded along the fold line 26 into a position over the bottom and side panels 12 and 14 as shown in FIG. 2. By this means, the glue flap 34 is adhered to the bottom panel 12. The cutouts 66 and 68 are positioned respectively over the retaining flaps 38 and 40 as shown in FIG. 2. Subsequently, application of glue is made to the top panel 20 along the free edge thereof as shown by the stippling in FIG. 2. Then, the top panel 20 and the side panel 16 are folded along the fold line 24 into a position over the top panel 18 as shown in FIG. 3. By this means, the areas of the top panels 18 and 20 overlapped with each other are adhered to each other in a flat face contacting relation, and the top panels 18 and 20 form in cooperation with each other a composite top panel of the cushion which composite panel has a width equal to the width (W1) of the bottom panel 12. This results in a cushion in a flat collapsed condition.

The flat structure thus preformed is assembled into a three dimensional cushion at a packing place where a water heater is packed in a shipping container, e.g., a corrugated board box/casing, and it is placed in the container at the position underneath the water heater. The cushion may be glued or otherwise secured by any conventional means to the bottom wall of the container if desired.

Figure 4:
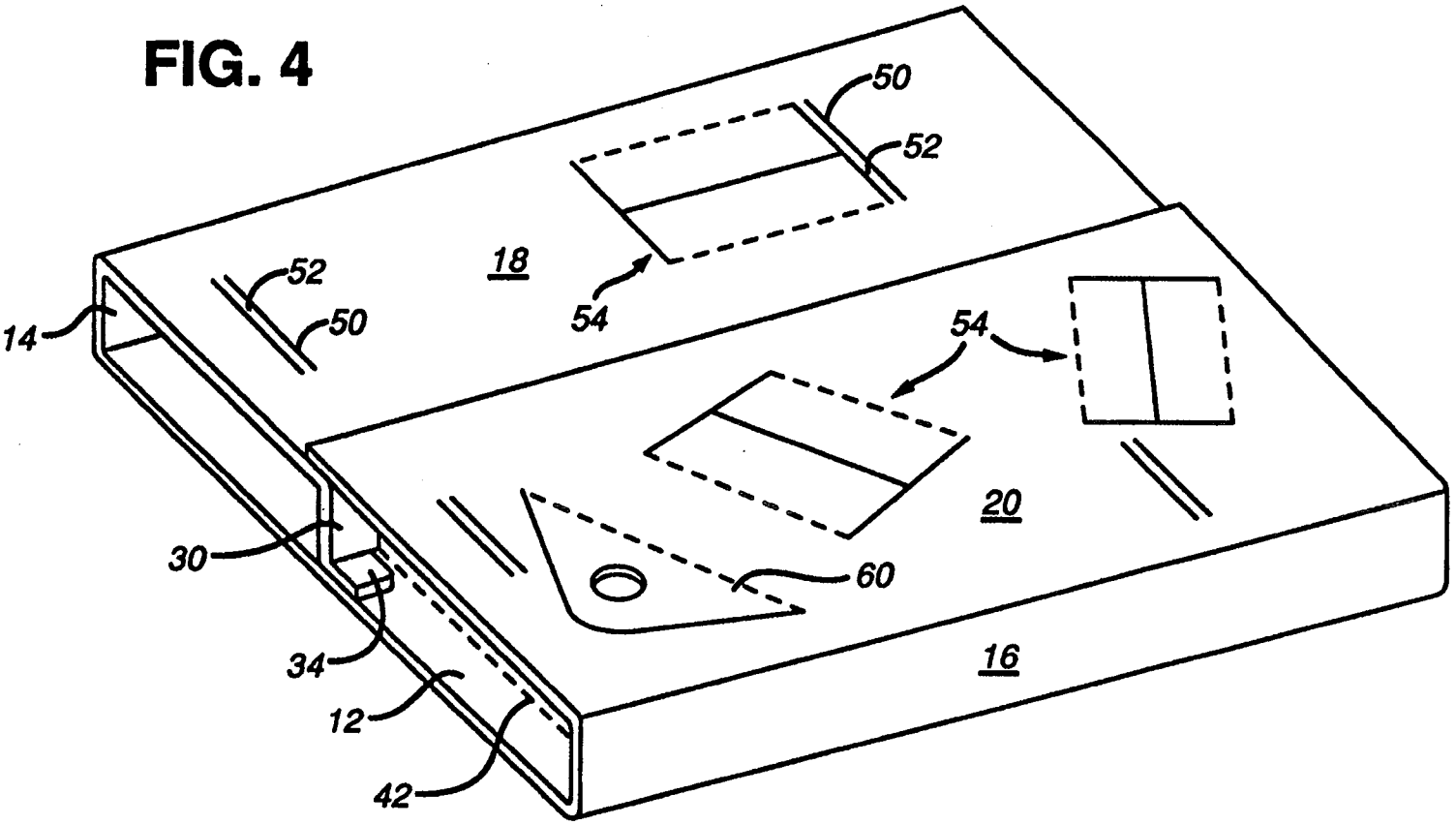
FIG. 4 is a perspective view of a cushion according to the present invention, that is formed from the blank of FIG. 1.

Assembly of the cushion is accomplished by erecting the side panels 14 and 16 so that they are disposed at right angle with respect to the bottom panel 12. By this means, the top panel 18 is naturally moved to a position where it is opposed to the bottom panel 12 in a parallel relation, and at the same time the center support panel 30 is also naturally erected upright with respect to the bottom panel 12. This forms the flat structure into a substantially tubular cushion as shown in FIG. 4.

Figure 5:
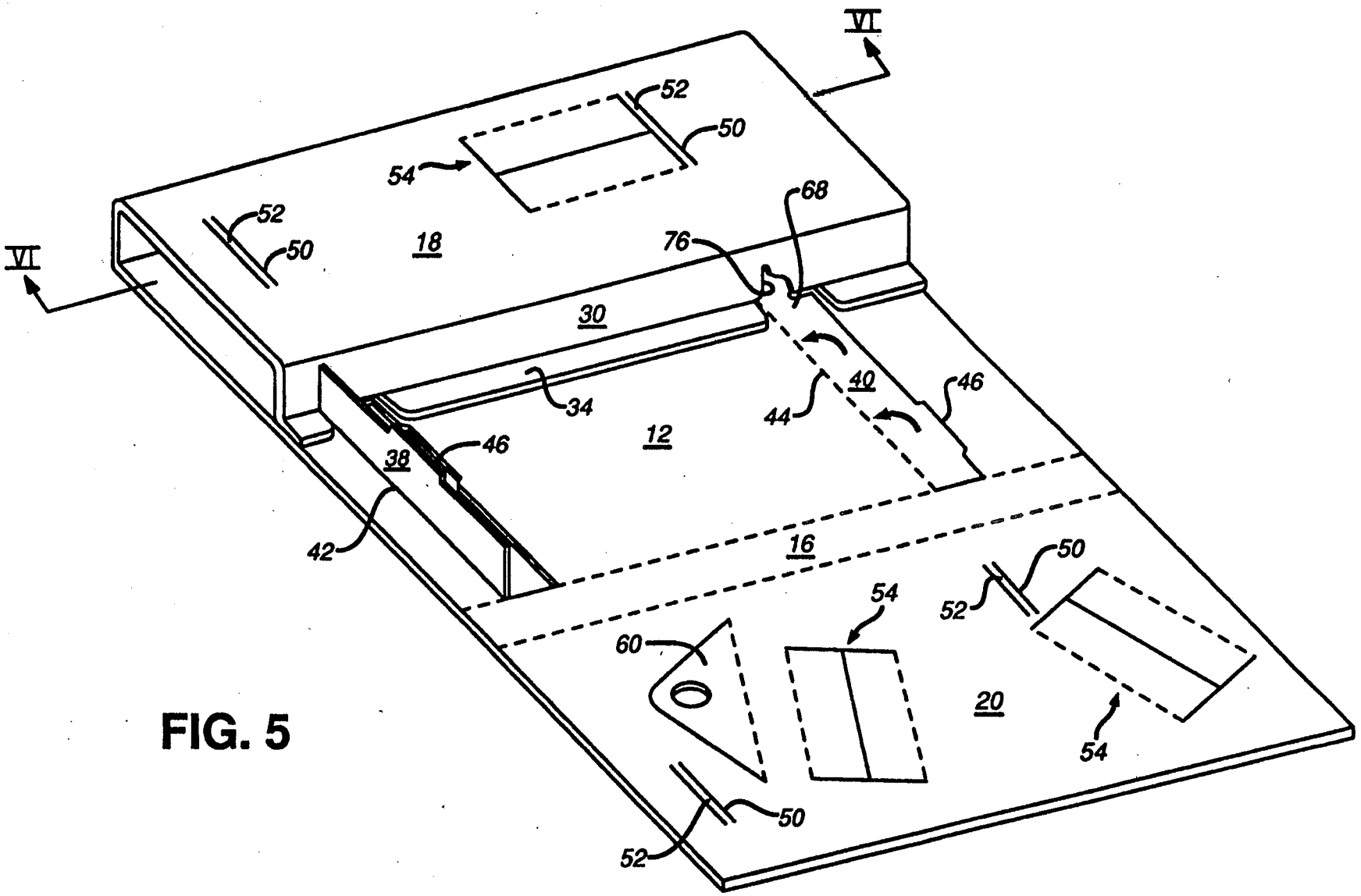
FIG. 5 is a perspective view of the cushion partly deployed to show retaining flaps.

After that, the retaining flaps 38 and 40 are pressed inwardly of the cushion and folded into the same. This is best illustrated in FIG. 5. When pressed, the flap 40 is pivoted about the crease line 44 in the direction indicated by the arrows in FIG. 5. The flap 40 passes through the larger portion 70 of the cutout 68, moves into the smaller portion 72, and finally abuts against the straight edge 76 of the smaller portion 72 to stand upright with respect to the bottom panel 12 like the flap 38 does in FIG. 5. The flap 38, in FIG. 5, is shown fully folded into an upright position where it extends all the way across the width of the cushion between the side panels 14 and 16. Both the flaps 38 and 40, when brought into their respective upright positions, hold the cushion in a squared, substantially tubular set-up condition as shown in FIG. 4.

Figure 6:
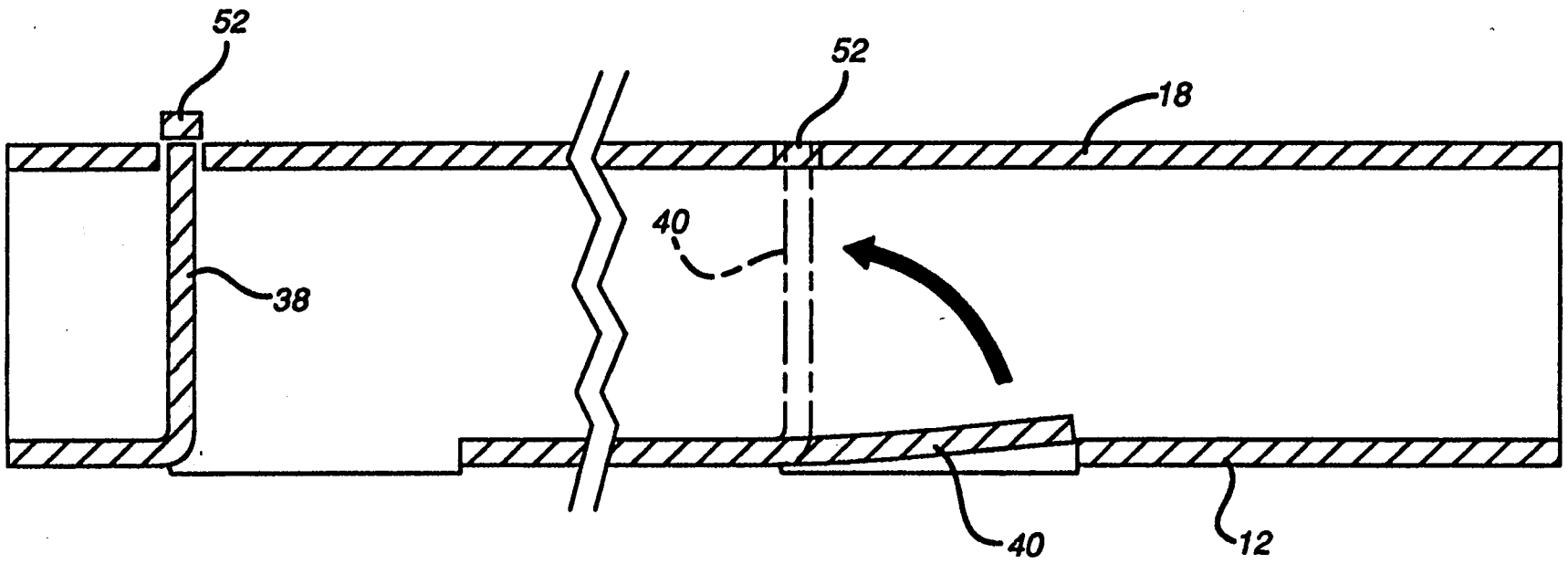
FIG. 6 is a fragmentary view taken along the line VI—VI in FIG. 5.

When the retaining flaps 38 and 40 are in the upright positions, the locking tabs 46 are received in the slots defined by the cut lines 50 in the top panel. This is shown in FIG. 6 wherein the strip 52 is displaced upwards due to the engagement of the locking tab 46 on the flap 38 with the associated slot. In like manner, the tab 46 on the other flap 40 is brought into engagement with the associated slot when the flap 40 is pivoted to the upright position shown by the dot and dash line in FIG. 6.

For the purpose of storage or transportation, the assembled cushion can be folded flat again into a collapsed condition by unlocking the retaining flaps 38 and 40, by pivoting the flaps 38 and 40 back to the initial positions, and by lowering the side panels 14 and 16. This collapsing/folding process is facilitated according to a structural feature of the cushion wherein the glue panel 34 extends from the lower end 36 of the center support panel 30 in a direction away from the side panel 14. Because of this feature, the cushion can be collapsed such that the top panel 18, the center support panel 30 and the glue flap 34 are disposed in the same plane, which minimizes folding stress in the cushion. If the glue flap extended toward the side panel 14, the support panel 30 would have to be folded onto the glue flap 34 or the top panel 18 would have to be folded onto the support panel 30 and the glue flap 34 upon collapsing of the cushion. This could induce greater stress in the cushion than the cushion of the present invention does.

Figure 7:
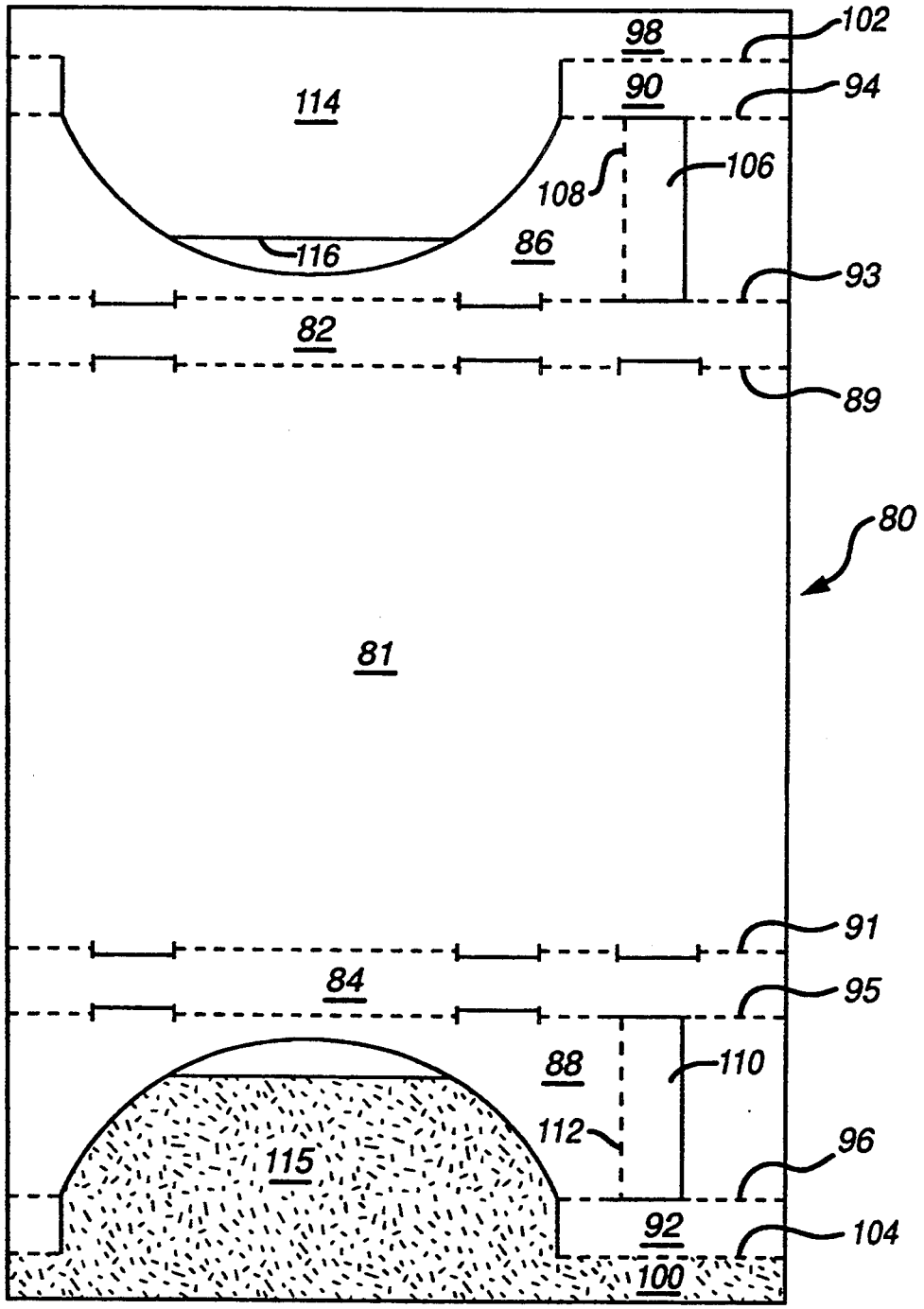
FIG. 7 is a plan view of a blank from which a cushion according to a second embodiment of the present invention is formed.

Another embodiment of the present invention is illustrated in FIG. 7 wherein a corrugated board cushion to be used with a generally cylindrical and legless water heater is depicted in blank form. The blank 80 includes a bottom panel 81, a pair of side panels 82 and 84 and a pair of top panels 86 and 88 that are of the sizes and shapes similar respectively to those of the preceding embodiment and that are mutually interconnected in the same manner as the preceding embodiment. A pair of support panels 90 and 92 are foldably joined to the top panels 86 and 88 along interrupted fold lines 94 and 96 respectively, and a pair of anchor flaps 98 and 100 are foldably joined to the support panels 90 and 92 along interrupted fold lines 102 and 104 respectively.

A retaining flap 106 is struck from the top panel 86 near one of the end edges thereof and is foldably joined to the top panel 86 along a fold line 108. Likewise, a retaining flap 110 is struck from the top panel 88 and is foldably joined to the top panel 88 along a fold line 112. The retaining flap 106 extends fully between the fold lines 93 and 94. In like manner, the retaining flap 110 extends fully between the fold lines 95 and 96.

According to this embodiment of the invention, the cushion is provided with a pair of generally semi-circular liner panels 114 and 115. Since these liner panels are virtually identical, only the liner panel 114 and the portions associated therewith will be described here in detail. The liner panel 114 is struck partially from the support panel 90 and partially from the top panel 86. This liner panel 114 is joined at the base thereof to the anchor flap 98 at the interrupted portion of the interrupted fold line 102. From the anchor flap 98, the panel 114 extends across the support panel 90 and enters into the top panel 86. As a result, the support panel 90 is separated into two sections by the liner panel 114.

In addition, the liner panel 114 is truncated along the free end edge 116 thereof. The distance between the end edge 116 and the fold line 93 is not less than the width of the side panel. Further, the liner panel 114 defines an opening partially in the top panel 86 and partially in the support panel 90. The arcuate edge of the part of the opening in the top panel 86 is complementary to a part of the circumference of a water heater to be packed in a shipping container together with this cushion.

Figure 8:
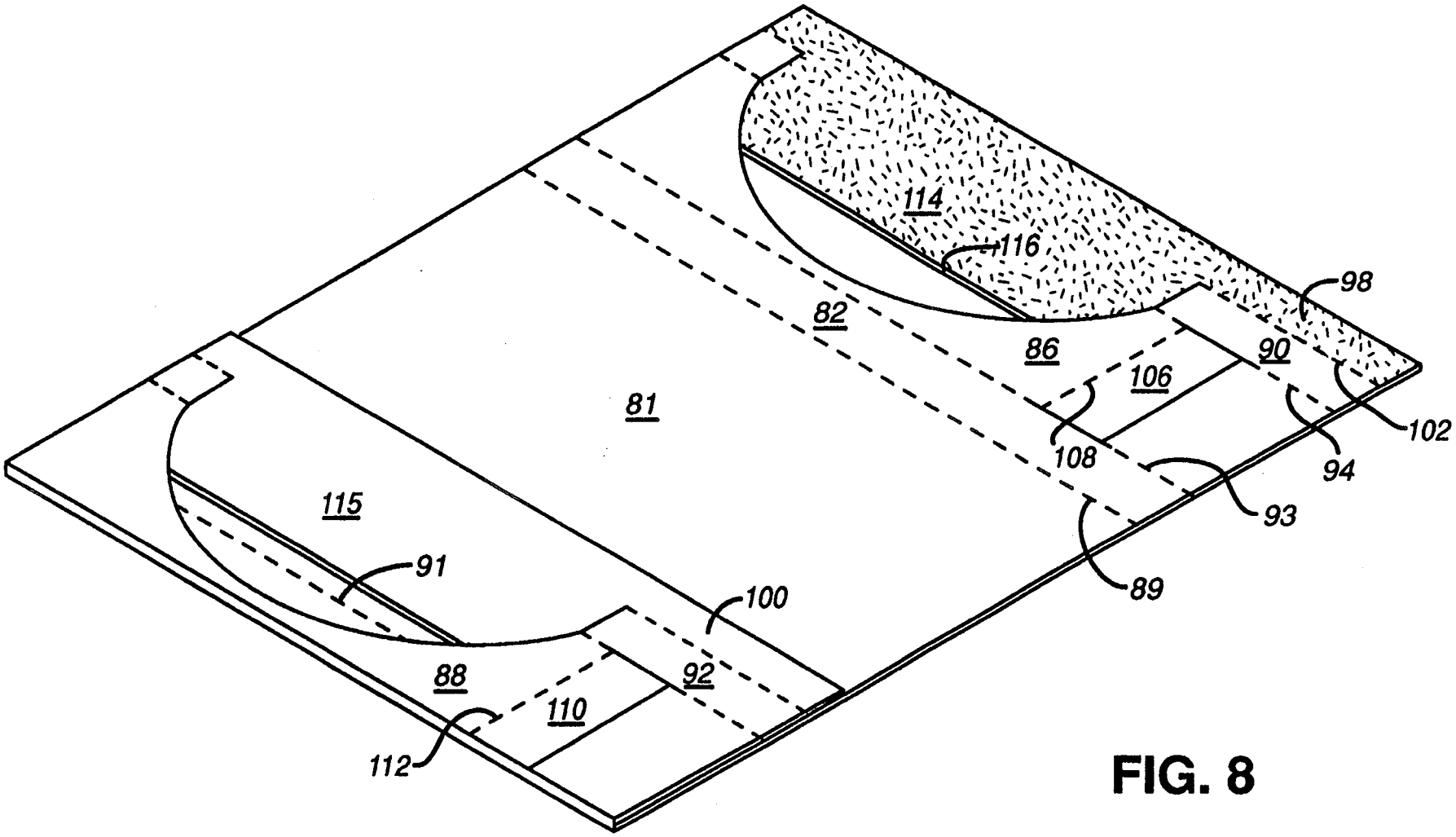
FIGS. 8 and 9 are perspective views depicting intermediate stages through which the blank of FIG. 7 is manipulated and glued in order to form a completed cushion of the present invention.
Figure 9:
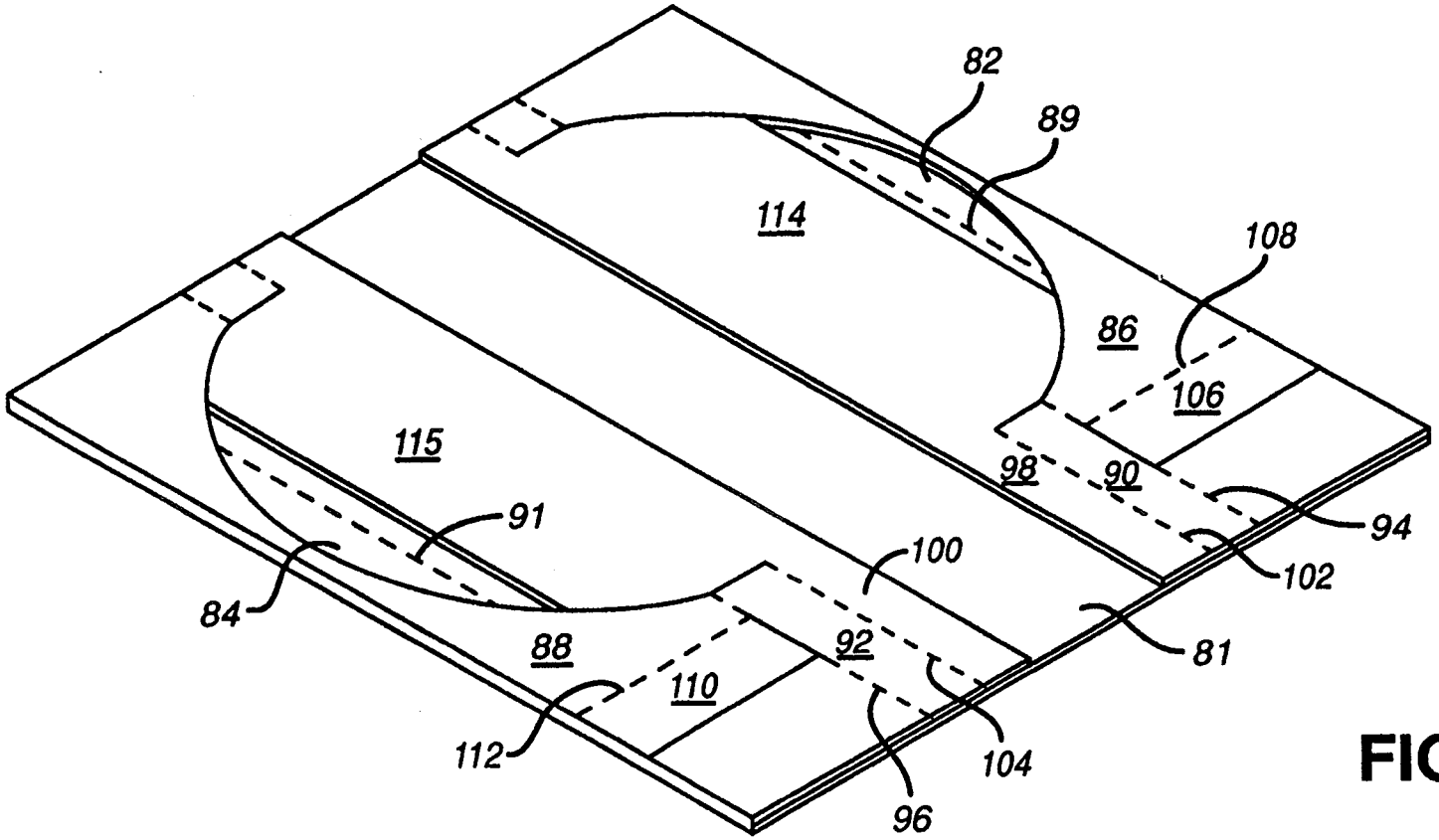

The blank 80 described above is also preformed into a flat collapsed structure preferably before it reaches a packaging place. The following steps are taken to preform a flat cushion. First, glue is applied to the anchor flap 100 and to the liner panel 115 as shown by the stippling in FIG. 7. Then the top, support and liner panels 88, 92 and 115 and the anchor flap 100 are folded along the fold line 95 into a position over the bottom and side panels 81 and 84 as shown in FIG. 8. In like manner, the anchor flap 98 and the liner panel 114 are applied with glue, and the top, support and liner panels 86, 90 and 114 and the anchor flap 98 are folded along the fold line 93 into a position as shown in FIG. 9. By this means, the anchor flaps 98 and 100 and the liner panels 114 and 115 are secured to the bottom panel 81 and thereby a cushion in a flat collapsed condition is completed. In FIG. 9, the anchor flaps 98 and 100 are spaced from each other and both of them are directly secured to the bottom panel 81; however, the anchor flaps may be arranged in contact at the free edges thereof with each other. Otherwise, the anchor flaps 98 and 100 may be superposed one on top of the other.

Assembly of this cushion is accomplished by pivoting the side panels 82 and 84 inwardly of the cushion about the fold lines 89 and 91 so that they are disposed upright with respect to the bottom panel 81. By this means, the top panels 86 and 88 are automatically moved to positions where they are opposed to the bottom panel 81 in a parallel relation, and at the same time the support panels 90 and 92 are also automatically pivoted about the interrupted fold lines 102 and 104 to the respective upright positions. The retaining flaps 106 and 110 are pressed and folded inwardly of the cushion to hold the cushion in a setup condition. This assembling process is very easily carried out for example by griping the opposite side edge portions of the flat cushion near the retaining flaps 106 and 110, pivoting the side panels 82 and 84 toward each other and pressing down the retaining flaps 106 and 110 by using the thumbs. This forms the flat cushion into a three-dimensional cushion with two tubular structures as shown in FIG. 10, wherein the anchor flaps 98 and 100 extends from the respective lower ends of the support panels 90 and 92 toward each other.

Figure 10:
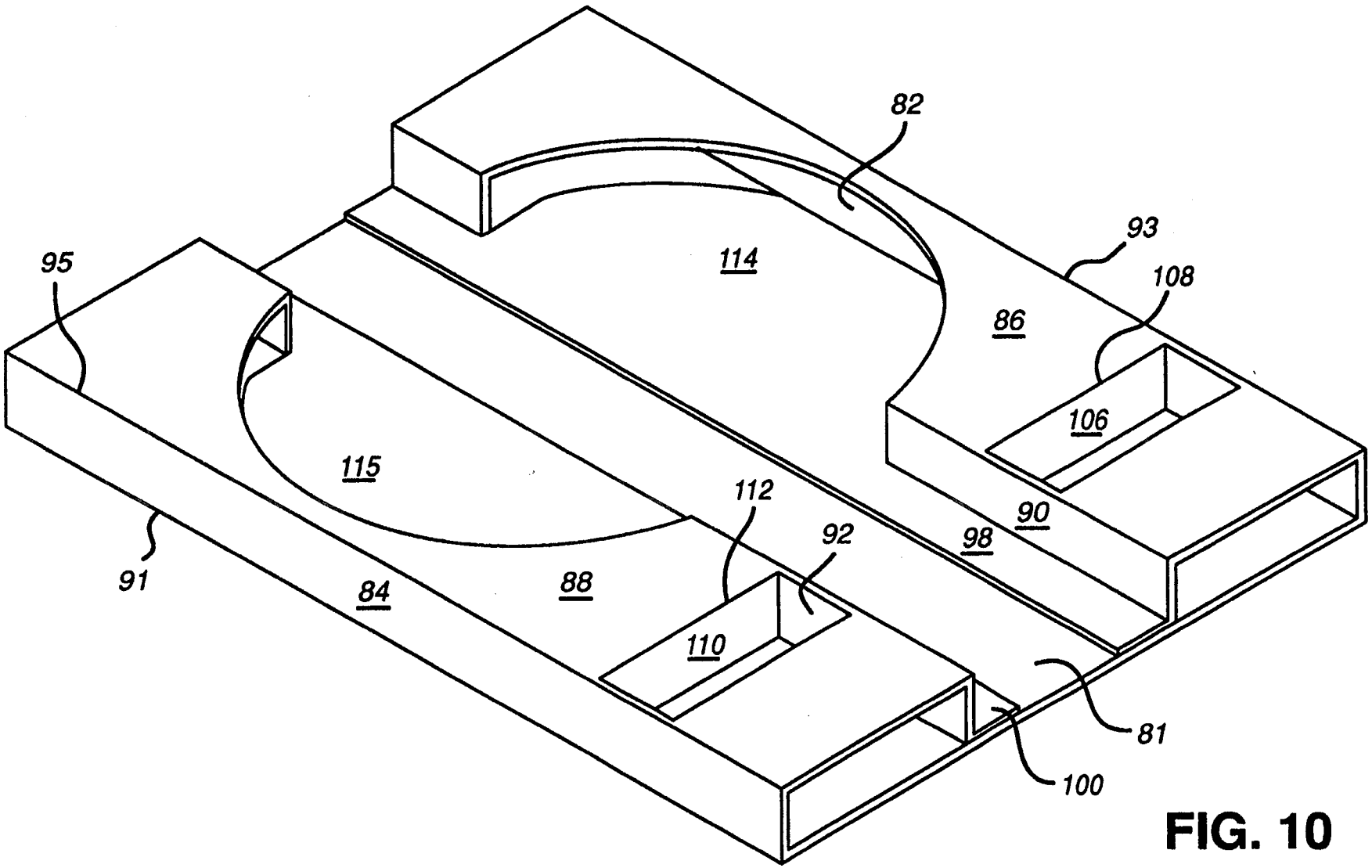
FIG. 10 is a perspective view of a completed cushion according to the second embodiment the present invention.

In the set-up condition illustrated in FIG. 10, the cushion is provided with two openings, i.e., one opening that is formed partially in the top panel 86 and partially in the support panel 90 and the other opening that is formed partially in the top panel 88 and partially in the support panel 92. These openings in combination forms a receptacle for the bottom of the cylindrical water heater. The portion of the cushion to be laid directly under the heater is structurally strengthened by the liner panels 114 and 115.

This cushion also provides a benefit of minimum folding stress when folded flat because it can be collapsed such that the top panels 86 and 88, the support panels 90 and 92 and the anchor flaps 98 and 100 are disposed in the same plane.

Having described the invention in detail and by reference to the preferred embodiments thereof, it will be apparent that modification and variation are possible without departing from the scope of the invention defined in the appended claims.

What is claimed is:

1. A cushioning member for placement into a shipping container, comprising:

a bottom panel having first and second opposite side edges;

a first side panel foldably joined to said first side edge of said bottom panel and extending to an upper end;

a first top panel foldably Joined to said upper end of said side panel and extending to a terminal end, said top panel being disposed in a spaced parallel relation to said bottom panel;

a first support panel foldably Joined to said terminal end of said top panel and extending to a lower end, said support panel being disposed in a spaced parallel relation to said side panel, said lower end being positioned between said first and second side edges of said bottom panel;

a first anchor flap foldably joined to said lower end of said support panel and secured to said bottom panel in a flat face contacting relation, said anchor flap extending from said lower end of said support panel toward said second side edge of said bottom panel whereby said cushioning member may be collapsed such that said top panel, said support panel and said anchor flap are disposed in the same plane; and retaining means for holding said cushioning member in a set-up condition in which said side, top and support panels and at least a portion of said bottom panel in cooperation form a squared tubular structure.

2. The cushioning member according to claim 1, further comprising a second side panel foldably joined to said second side edge of said bottom panel and extending to an upper end, said second side panel being disposed in a spaced parallel relation to said first side panel, and a second top panel foldably joined to said upper end of said second side panel and extending toward said first side panel, said second top panel being disposed in a spaced parallel relation to said bottom panel and being secured to said first top panel in an overlapping relation.

3. The cushioning member according to claim 1, further comprising a second side panel foldably joined to said second side edge of said bottom panel and extending to an upper end, said second side panel being disposed in a spaced parallel relation to said first side panel, a second top panel foldably joined to said upper end of said second side panel and extending toward said first side panel, said second top panel being disposed in a spaced parallel relation to said bottom panel, a second support panel foldably joined to said second top panel and extending to a lower end, said second support panel being disposed in a spaced parallel relation to said second side panel, said lower end of said second support panel being positioned between said first anchor flap and said second side edge of said bottom panel, and a second anchor flap foldably joined to said lower end of said second support panel and secured to said bottom panel in a flat face contacting relation, said second anchor flap extending from said lower end of said second support panel toward said first anchor flap whereby said cushioning member may be collapsed such that said second top panel, said second support panel and said second anchor flap are disposed in the same plane.

4. The cushioning member according to claim 3, wherein said first and second support panels are spaced from each other.

5. The cushioning member according to claim 3, wherein in said set-up condition, said second side panel, said second top panel, said second support panel and a portion of said bottom panel in cooperation form a second squared tubular structure.

6. The cushioning member according to claim 5, wherein said retaining means comprises a retaining flap struck from each of said first and second top panels, said retaining flap being foldably joined to said each top panel and being folded into respective one of said tubular structures to extend between respective one of said first and second side panels and respective one of said first and second support panels.

7. The cushioning member according to claim 6, wherein said retaining flap is disposed adjacent to said respective side panel whereby said retaining flap is easy to manipulate when said respective side panel is gripped.

8. The cushioning member according to claim 1, further comprising a liner panel joined to said anchor flap, said liner panel extending from said anchor flap toward said side panel and being secured to said bottom panel in a flat face contacting relation so as to reinforce said bottom panel, said liner panel being formed by material struck partially from said top panel and partially from said support panel to minimize material requirement.

9. The cushioning member according to claim 8, wherein said cushioning member is provided with an opening for receiving a portion of an article to be packed in a shipping container together with said cushioning member, said opening being defined by said liner panel and being formed partially in said top panel and partially in said support panel.

10. The cushioning member according to claim 3, further comprising first and second liner panels joined respectively to said first and second anchor flaps and extending respectively toward said first and second side panels, said liner panels being secured to said bottom panel in a flat face contacting relation so as to reinforce said bottom panel, said first liner panel being formed by material struck partially from said first top panel and partially from said first support panel, said second liner panel being formed by material struck partially from said second top panel and partially from said second support panel.

11. The cushioning member according to claim 10, wherein said cushioning member is provided with first and second openings defined respectively by said first and second liner panels, said first opening being formed partially in said first top panel and partially in said first support panel, said second opening being formed partially in said second top panel and partially in said second support panel, said first and second openings in combination forming a receptacle for receiving a portion of an article to be packed in a shipping container together with said cushioning member.

12. The cushioning member according to claim 10, wherein each of said first and second anchor flaps is joined to respective one of said first and second support panels along an interrupted fold line, and each of said liner panels is joined to respective one of said anchor flaps at an interrupted portion of said interrupted fold line.

13. A shipping container comprising a casing defining an internal space for receiving an article, said casing having a bottom wall, and a cushioning member received in said internal space of said casing and disposed on said bottom wall, said cushioning member comprising:

a bottom panel having first and second opposite side edges;

a side panel foldably joined to said side edge of said bottom panel and extending to an upper end;

a top panel foldably joined to said upper end of said side panel and extending to a terminal end, said top panel being disposed in a spaced parallel relation to said bottom panel;

a support panel foldably joined to said terminal end of said top panel and extending to a lower end, said support panel being disposed in a spaced parallel relation to said side panel, said lower end being positioned between said first and second side edges of said bottom panel; and an anchor flap foldably joined to said lower end of said support panel and secured to said bottom panel in a flat face contacting relation, said anchor flap extending from said lower end of said support panel toward said second side edge of said bottom panel whereby said cushioning member may be collapsed such that said top panel, said support panel and said anchor flap are disposed in the same plane.

14. The shipping container according to claim 13, wherein said bottom panel of said cushioning member is secured to said bottom wall of said casing.

15. The shipping container according to claim 13, wherein said cushioning member further comprises a liner panel joined to said anchor flaps, said liner panel extending from said anchor flaps toward said side panel and being secured to said bottom panel in a flat face contacting relation so as to reinforce said bottom panel, said liner panel being formed by material struck partially from said top panel and partially from said support panel to minimize material requirement.

16. The shipping container according to claim 15, wherein said cushioning member is provided with an opening for receiving a portion of the article to be packed in said casing, said opening being defined by said liner panel and being formed partially in said top panel and partially in said support panel.

17. The cushioning member according to claim 1, wherein said retaining means comprises a retaining flap struck from said top panel, said retaining flap being foldably joined to said top panel and being folded into said tubular structure to extend between said side panel and said support panel.

18. A cushioning member for placement into a shipping container, comprising:

a bottom panel having first and second opposite side edges;

a first side panel foldably joined to said first side edge of said bottom panel and extending to an upper end;

a first top panel foldably joined to said upper end of said first side panel and disposed in a spaced parallel relation to said bottom panel;

a first support panel foldably joined to said first top panel and extending to a lower end, said first support panel being disposed in a spaced parallel relation to said first side panel, said lower end being positioned between said first and second side edges of said bottom panel;

a first anchor flap foldably joined to said lower end of said first support panel and extending toward said second side edge of said bottom panel, said first anchor flap being secured to said bottom panel in a flat face contacting relation;

a second side panel foldably joined to said second side edge of said bottom panel and extending to an upper end, said second side panel being disposed in a spaced parallel relation to said first side panel;

a second top panel foldably joined to said upper end of said second side panel and extending toward said first side panel, said second top panel being disposed in a spaced parallel relation to said bottom panel;

a second support panel foldably joined to said second top panel and extending to a lower end, said second support panel being disposed in a spaced parallel relation to said second side panel;

a second anchor flap foldably joined to said lower end of said second support panel and extending toward said first side panel, said second anchor flap being secured to said bottom panel in a flat face contacting relation, whereby said cushioning member may be collapsed such that said first and second top panels, said first and second support panels and said first and second anchor flaps are all disposed in the same plane; and retaining means for holding said cushioning member in a set-up condition in which said first side, first top and first support panels and at least a portion of said bottom panel in cooperation form a first squared tubular structure and in which said second side, second top and second support panels and at least a portion of said bottom panel in cooperation form a second squared tubular structure, said retaining means comprising a retaining flap struck from each of said first and second top panels, said retaining flap being foldably joined to said each top panel and being folded into respective one of said tubular structures to extend between respective one of said first and second side panels and respective one of said first and second support panels.

19. The shipping container according to claim 13, wherein said cushioning member further comprises retaining means for holding said cushioning member in a set-up condition in which said side, top and support panels and at least a portion of said bottom panel in cooperation form a squared tubular structure, said retaining means comprising a retaining flap struck from said top panel, said retaining flap being foldably joined to said top panel and being folded into said tubular structure to extend between said side panel and said support panel.

20. The shipping container according to claim 13, wherein said cushioning member further comprises a second side panel foldably joined to said second side edge of said bottom panel and extending to an upper end, said second side panel being disposed in a spaced parallel relation to said first side panel, a second top panel foldably joined to said upper end of said second side panel and extending toward said first side panel, said second top panel being disposed in a spaced parallel relation to said bottom panel, a second support panel foldably joined to said second top panel and extending to a lower end, said second support panel being disposed in a spaced parallel relation to said second side panel, said lower end of said second support panel being positioned between said first anchor flap and said second side edge of said bottom panel, and a second anchor flap foldably joined to said lower end of said second support panel and extending toward said first anchor flap, said second anchor flap being secured to said bottom panel in a flat face contacting relation, whereby said cushioning member may be collapsed such that said second top panel, said second support panel and said second anchor flap are disposed in the same plane.

21. The shipping container according to claim 20, wherein said cushioning member further comprises retaining means for holding said cushioning member in a set-up condition in which said first side, first top and first support panels and at least a portion of said bottom panel in cooperation form a first squared tubular structure and in which said second side, second top and second support panels and at least a portion of said bottom panel in cooperation form a second squared tubular structure.

22. The shipping container according to claim 21, wherein said retaining means comprises a retaining flap struck from each of said first and second top panels, said retaining flap being foldably joined to said each top panel and being folded into respective one of said tubular structures to extend between respective one of said first and second side panels and respective one of said first and second support panels.

23. The shipping container according to claim 22, wherein said retaining flap is disposed adjacent to said respective side panel whereby said retaining flap is easy to manipulate when said respective side panel is gripped.

* * * * *

UNITED STATES PATENT AND TRADEMARK OFFICE

CERTIFICATE OF CORRECTION

PATENT NO. : 5,385,238

DATED : January 31, 1995

INVENTOR(S) : Gary D. Lancaster, Greg A. Hutcheson

It is certified that error appears in the above-identified patent and that said Letters Patent is hereby corrected as shown below:

Column 9, line 39, "side edge" should read --first side edge--.

Signed and Sealed this

Fifth Day of March, 1996

*Attest:*

Bruce Lehman

BRUCE LEHMAN

*Attesting Officer*

*Commissioner of Patents and Trademarks*